US006560884B1

(12) United States Patent
Afshari

(10) Patent No.: US 6,560,884 B1
(45) Date of Patent: May 13, 2003

(54) FIXED PIN BOW SIGHT

(76) Inventor: Abbas Ben Afshari, 1553 E. Center, Pocatello, ID (US) 83201

( * ) Notice: Subject to any disclaimer, the term of this patent is extended or adjusted under 35 U.S.C. 154(b) by 0 days.

(21) Appl. No.: 09/989,935

(22) Filed: Nov. 20, 2001

(51) Int. Cl.[7] ..... F41G 1/467
(52) U.S. Cl. ..... 33/265; 124/87
(58) Field of Search ..... 33/264; 124/87, 124/88

(56) References Cited

U.S. PATENT DOCUMENTS

| | | | | | |
|---|---|---|---|---|---|
| 2,574,599 | A | * | 11/1951 | Stieber | 124/87 |
| 3,310,875 | A | * | 3/1967 | Kowalski | 33/265 |
| 4,244,115 | A | * | 1/1981 | Waldorf | 33/265 |
| 4,385,448 | A | * | 5/1983 | Burkey | 33/265 |
| 4,584,777 | A | * | 4/1986 | Saunders | 33/265 |
| 4,984,373 | A | * | 1/1991 | Forrest | 124/87 |
| 5,231,765 | A | * | 8/1993 | Sherman | 33/265 |
| 5,419,303 | A | * | 5/1995 | Stewart | 124/87 |
| 5,435,068 | A | * | 7/1995 | Thames et al. | 124/87 |
| 5,864,958 | A | * | 2/1999 | Giddens | 124/87 |
| 6,418,633 | B1 | * | 7/2002 | Rager | 124/87 |

* cited by examiner

*Primary Examiner*—G. Bradley Bennett
(74) *Attorney, Agent, or Firm*—Morriss, Bateman O 'Bryant & Compagni

(57) ABSTRACT

A fixed pin bow sight is comprised of a bow sight having an attachment portion, a sight pin mounting portion and a sight pin having a plurality of sight tips on said sight pin. Each of the sight tips are predisposed on the sight pin and spaced to provide accurate targeting of an arrow shot from a bow having a particular shooting speed. The spacing between sight tips is defined by the desired targeting distances from the bow. For example, the uppermost sight tip may be configured for a target that is twenty yards away with subsequent sight tips provided for ten yard increments (e.g., 30, 40, 50 and 60 yards). The sight tips are configured to be vertically aligned relative to the ground when firing the bow so that as the distance from target is increased the appropriate sight tip moves from top to bottom of the sight pin.

19 Claims, 11 Drawing Sheets

FIXED PIN BOW SIGHT

BACKGROUND OF THE INVENTION

1. Field of the Invention

This invention relates generally to sights for archery bows and, more specifically, to bow sights having sight pin constructions that are pre-set for a particular bow so as to reduce the amount of adjustment necessary to sight in the bow sight to the bow.

2. Description of the Art

Archery bow sights utilizing a plurality of sight pins have been known in the art for many years. Typically, these sights use a bracket or other mounting structure for mounting the sight to a bow. The sight is commonly comprised of a pin plate, a pin guard, and a plurality of sight pins which are secured to the pin plate and extend into a sight window formed by the pin guard. The sight is mounted to a bow in a manner so that when the bow string is drawn, the archer can look through a peep sight provided in the bow string and align the tip of a pin attached to the sight with a target. For sights utilizing a plurality of sight pins having their tips vertically aligned, each individual sight pin is typically provided for aiming the bow at a target at a particular distance from the archer. For example, one pin may be positioned in the sight for aiming the bow at a target 50 yards from the archer while another pin may be positioned for a target that is at 70 yards distance.

An example of a bow sight known in the art is illustrated in FIG. 1 in which a bow sighting device 10 is connected to an archery bow 12. The sighting device 10 is comprised of a pin plate 14, a pin guard 16 and a sight window 18 formed therebetween. A plurality of sight pins 20 are secured to the pin plate 14 by attachment members 22, such as screws, which engage the sight pins 20 and extend through a slot 24 formed in the pin plate 14. The sight pins 20 extend transversely from the pin plate 14 into the sight window 18. The sighting device 10 is attached to a first bracket 28 by securement members 30. The first bracket 28 may be adjustably connected to a second bracket 32 by securement members 34, and the second bracket 32 may be adjustable secured to a third bracket 36 by screw members 38, which attach it to the bow 12.

In use, the archer typically aligns a peep sight positioned on or formed in the bowstring with one of the sight pins 20. In order to properly sight in the sight to the bow (i.e., properly adjust sight pin to a particular distance from the target), each of the sight pins 20 is individually positioned and adjusted to correspond to a given distance (e.g., 20 yards, 40 yards, 60 yards, etc.) from the bow 12. The sight pins 20 allow the archer to better position the aim of the arrow to compensate for target distance and trajectory. Thus, the archer must position him/herself a specific distance from the target (e.g., 20 yards) and shoot several arrows at the target while adjusting the 20 yard sight pin until the position of the 20 yard sight pin corresponds to arrows hitting the center of the target.

The same procedure is repeated for each of the other sight pins (e.g., 30 yard pin, 40 yard pin, 50 yard pin, etc.). In most cases, upon repeated shooting, the sight pins can be fairly closely positioned relative to the bow sight at positions that provide acceptable targeting. As the distance from the target increases, however, it becomes increasingly more difficult to sight in the pins as the shooters ability to hold the bow steady during targeting becomes more important. That is, at close range, slight movement of the bow during a shot will have less effect on the arrows trajectory relative to the target than will similar movements at long range. Thus, while the error of the position of each sight pin may be approximately equal, such errors are not as detrimental at close range, but are exacerbated as the distance-to-target increases.

Some bow sights provide a single sight pin. Such single pin bow sights are provided for target practice where the distance from the target does not change. Single pin bow sights are also used in sights commonly referred to as pendulum sights that are used in conjunction with tree stands and the like where the hunter is positioned above the target and is aiming in a severely downward direction at the ground to animals below the hunter. In such a situation, the distance to target, while not fixed, is usually within a small range thus suited for a single pin sight arrangement.

Once a single pin sight is adjusted for a particular distance-to-target, the sight is not suited for being used at other ranges. It would be desirable, however, to provide a fixed pin arrangement that can also be used at other ranges without requiring adjustment or re-sighting of the sight pin to accommodate such other distances-to-target. In addition, it would be advantageous to provide a single sight pin structure having multiple sight points configured for attachment to conventional type bow sights.

SUMMARY OF THE INVENTION

Accordingly, a fixed pin bow sight is comprised of a bow sight having an attachment portion, a sight pin mounting portion and a sight pin having a plurality of sight tips on said sight pin. Each of the sight tips are predisposed on the sight pin and spaced to provide accurate targeting of an arrow shot from a bow having a particular shooting speed. The spacing between sight tips is defined by the desired targeting distances from the bow. For example, the uppermost sight tip may be configured for a target that is twenty yards away with subsequent sight tips provided for ten yard increments (e.g., 30, 40, 50 and 60 yards). The sight tips are configured to be vertically aligned relative to the ground when firing the bow so that as the distance from target is increased the appropriate sight tip moves from top to bottom of the sight pin.

Another important aspect of the present invention is to ensure that the distance from the sight tips to the peep sight, which is dependent upon the draw of the bow is at a predetermined distance. That is, in order to make the sight tips accurate representations of the target at various distances, the distance from the sight tips to the eye of the archer is factored into the formation of the distance between adjacent sight tips. Because many bows having different draw lengths that may be customized to the archer, the sight also includes brackets or other attachment features that allows the sight to be adjusted either toward or away from the eye of the user at full draw of the bow in order to be positioned at the optimal distance.

In one embodiment, the distance between the sight tips and the peep sight is approximately 26.5 inches. The spacing between sight tips are determined in part based upon this 26.4 inch distance. In order to provide precise sighting of the sight pins for a given bow speed, the distance between sight tips is based upon a peep sight to sight tip distance of approximately 26.4 inches. Such accuracy, however, is not necessary for most practical purposes such as hunting. After the first or uppermost sight tip is sighted in, the remaining sight pins will relatively accurately reflect the other given distances to target. That is, even if the distance from the sight tips to the peep sight is something other than 26.4 inches, such variations in the sight tips to peep sight distance may only have an inch or two difference in the accuracy of the sight tips for a given distance to target. Such variation in accuracy (e.g., one to two or more inches) will still likely accomplish a hit in a vital organ of an animal. Thus, in practicality, the sight may be fixed relative to the bow and not necessarily adjustable thereto in a direction relative to the peep sight given the fact that most bows have a draw at or near about 26 inches.

The spacing between sight tips is calculated using conventional ballistic formulas. Such formulas can be found in an article entitled "Exterior Ballistics of Bows and Arrows" by W. J. Rheingans, herein incorporated by this reference. Unlike conventional multiple pin bow sights which require each sight pin to be individually sighted, the bow sight of the present invention only requires sighting in of one of the sight tips. Once one of the sight tips is properly sighted to a target at the appropriate distance for the particular sight tip, the remaining sight tips are automatically sighted in.

In order to sight in the sight pin of the present invention, the bow sight is attached to the riser of the bow and adjusted so that the sight pin will be a particular distance from the peep sight on the bow string. The bow sight is then adjusted to provide proper targeting of a target that is a distance corresponding to the sight tip. For example, if the top sight tip is configured for a distance-to-target of 20 yards, the archer can position him/herself 20 yards from the target and shoot arrows at the target. The position of the sight relative to the riser or the position of the sight pin relative to the sight can then be adjusted vertically or horizontally as required to properly sight in the first sight tip. Once, the first sight tip is set, the remaining sight tips are automatically sighted in as they are fixed relative to the first sight tip.

The sight pin of the present invention may be integrally formed with the sight or may be a separate component that is attached to the sight.

In the case where the sight pin is a separate component, the sight pin may be configured to fit into conventional type bow sights that utilize multiple sight pins. As such, the sight pin of the present invention may be configured to replace conventional sight pins without requiring replacement of the entire sight in order to utilize the novel features of the present invention.

The sight pin of the present invention is further configured to match the shooting speed of the bow. For example, some bows shoot at 250 feet per second while others will shoot at 280 feet per second. The speed of the bow can be easily determined by standard bow speed calculation equipment. In addition, most compound type bows allow for adjustment of the bow speed. Thus, sights or sight pins in accordance with the present invention can be configured to a few standardized bow speeds and the bow adjusted to match the sight or sight pin.

In one embodiment, the sight pin is comprised of a vertical element having a plurality of fiber optic elements coupled to the sight pin each at a particular position along the height of the sight pin. The fiber optic elements extend from the sight pin through the pin guard of the sight, wrap around a portion of the pin guard and are attached to the pin guard at another location. By increasing the length of the fiber optic elements, their individual exposure to ambient light is increased to help increase the brightness of each sight tip.

In another embodiment, the sight pin is configured to mate with a sight in a more conventional fashion by mating with a slot in the pin plate of the sight. A plurality of sight pins are fixed relative to a mounting portion with each of the sight pins coupled or mounted to a single mounting structure.

In another embodiment, the sight pin is configured to mate with a conventional type bow sight but includes a single vertical pin horizontally supported with a mounting structure. If fiber optic sighting elements are utilized, the fiber optic members may have various configurations that expose a portion of their length to ambient light in order to increase their brightness for viewing by the archer.

By providing a sight pin with multiple sight tips in a pre-configured arrangement, the sight tips can be relatively precisely (within manufacturing tolerances) placed along the sight pin at the appropriate locations. Such a configuration is vastly more accurate than requiring the user to sight in each individual sight pin relative to the sight where such pins can be off from the correct position by orders of magnitude greater than that which can be achieved through manufacturing.

BRIEF DESCRIPTION OF THE DRAWINGS

FIGS. 15A and 14B are front and side views, respectively of a seventh embodiment of a fixed pin bow sight in accordance with the principles of the present invention.

DETAILED DESCRIPTION OF THE INVENTION

Figure 1:
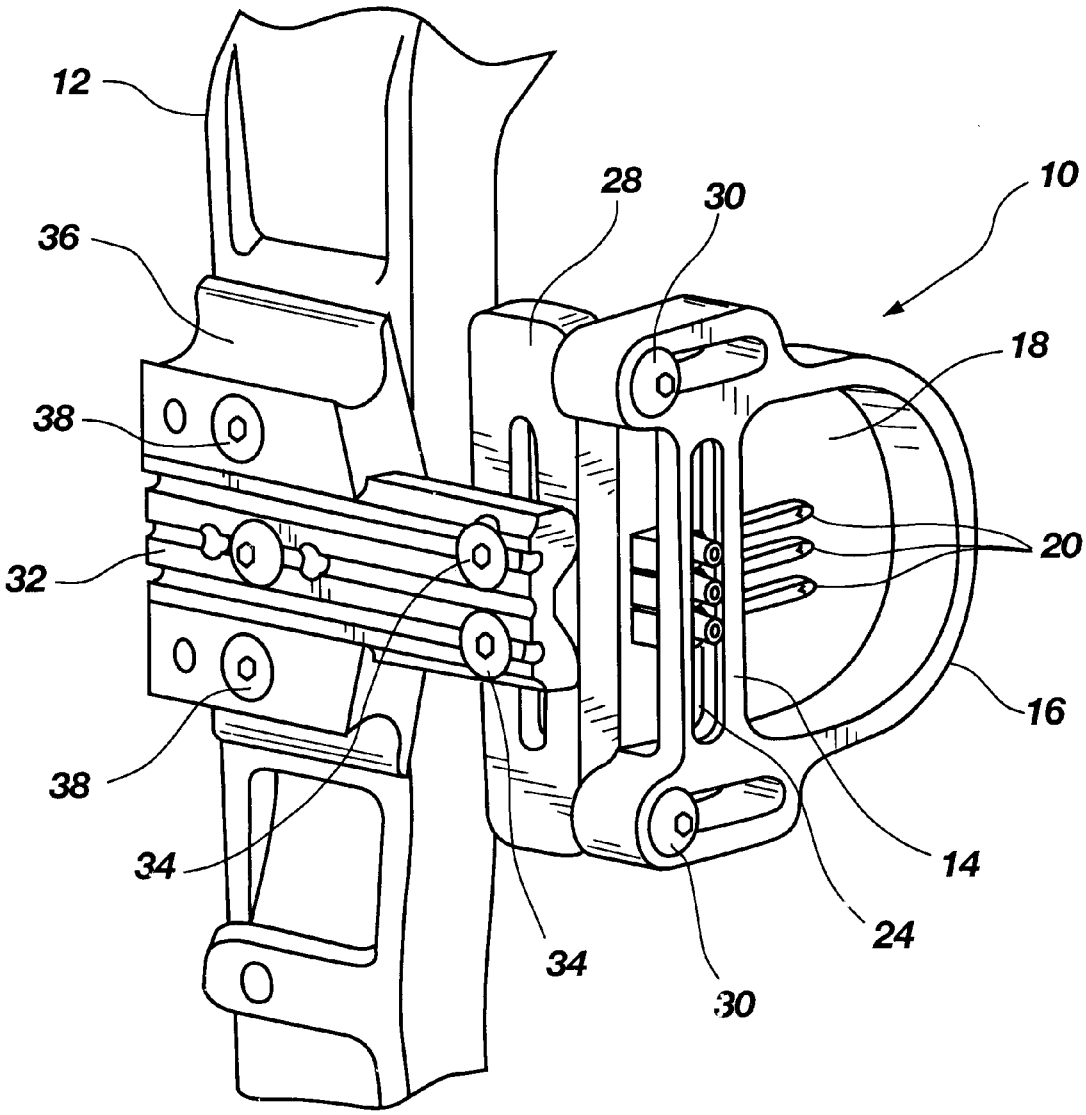
FIG. 1 (PRIOR ART)
FIG. 1 is a perspective view of a prior art archery sight illustrating its elements of construction and its attachment to an archery bow.
Figure 2C:
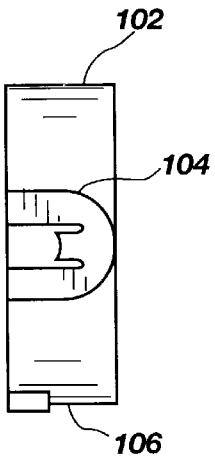
FIGS. 2A, 2B, 2C, 2D and 2E are front, cross-sectional side, end, top and bottom views of a first embodiment of a fixed pin bow sight in accordance with the principles of the present invention.
Figure 2D:
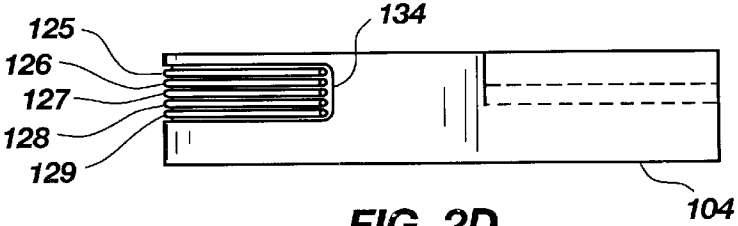
Figure 2A:
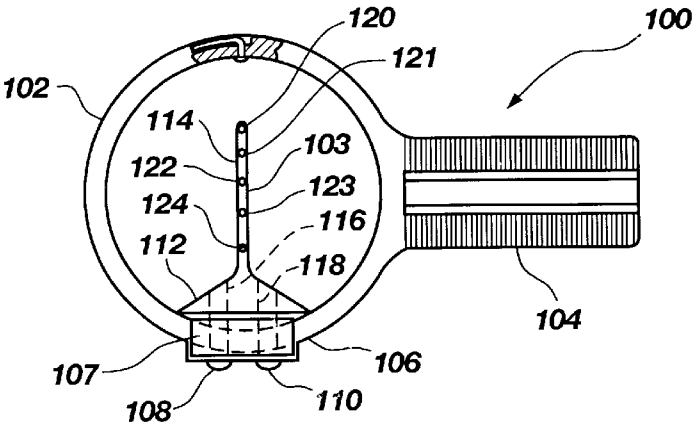
Figure 2E:
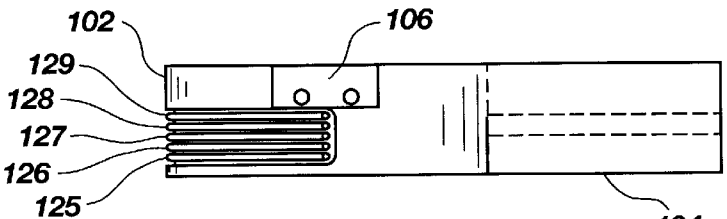
Figure 2B:
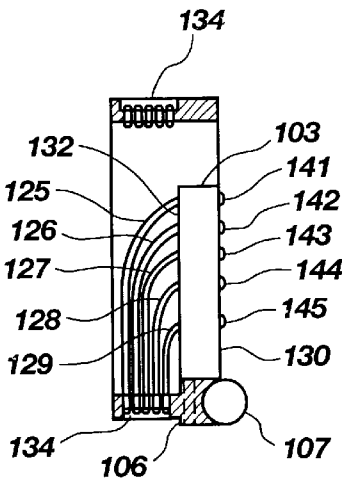

FIGS. 2A–2E illustrate a first embodiment of a bow sight, generally indicated at 100, in accordance with the principles of the present invention. The sight 100 is comprised of a pin guard portion 102 for protecting the sight pin 103 and a pin mounting portion 104 for mounting the sight 100 to a mounting bracket (not shown). In this embodiment, the sight pin 103 is a separate component from the rest of the sight 100 and is attached to a pin mounting portion 106 as with fasteners 108 and 110. A leveling mechanism 107, such as a leveling bubble, is attached to the sight 100 proximate the pin mounting portion 106. The leveling bubble 107 is provided to allow an archer to ensure that the sight 100 is properly horizontally oriented when aiming the sight at a target to provide more accurate targeting.

The sight pin 103 is comprised of a base portion 112 configured for mounting the sight pin 103 to the pin mounting portion 106 of the sight 100 and for providing structural stability to the sighting portion 114 of the sight pin. The base portion is provided with a pair of internally threaded bores 116 and 118 for engaging with externally threaded fasteners 108 and 110 to mount the sight pin 103 to the pin mounting portion 106.

The sighting portion 114 is comprised of an elongate post member with a plurality of sight tips 120, 121, 122, 123 and 124 attached thereto. Typically, a sight pin is provided with a single aiming structure, such as a bead or the exposed end of a fiber optic element, provided on the "tip" of the sight pin. The term sight tip is thus commonly used to refer to this part of the sight pin that is used as the aiming reference. In the present invention, however, the term sight tip refers to the aiming reference regardless of its position on the sight pin. Thus, reference herein to a plurality of sight tips is a referring to the plurality of aiming references, even those not positioned on the "tip" of the sight pin.

Each of the sight tips 120–124 is comprised of the exposed end of a fiber optic member. The fiber optic members 125, 126, 127, 128 and 129 extend through transversely extending bores in the sight pin 103 with their exposed ends terminating on the face 130 of the sight pin 103. The fiber optic members 125–129 extend from the back 132 of the sight pin 103 through holes in the sight 100 proximate the pin attachment portion 106. A circumferential channel 134 extends around the perimeter of the pin guard 102 for containing the fiber optic members 125–129. Thus, the fiber optic members are positioned in the channel 135 and wrap around a portion of the guard 102. A plurality of holes are provided in the top of the guard 102 for receiving the distal ends of each of the fiber optic elements 125–129. The distal ends are provided with a bead, as by a melting process, in order to hold the distal ends of the fiber optic members 125–129 relative to the guard 102. The distal ends may also be glued into the holes or just held flat against the channel 135 as with an adhesive or an adhesive tape without insertion into the holes. By wrapping the fiber optic members 125–129 around the guard 102 in a manner that exposes a large surface area of the fiber optic elements 125–129 to ambient light, the light gathering potential for each fiber optic element 125–129 is significantly increased. It is also contemplated that a luminescent material, such as a luminescent tape or coating may be applied to or positioned in the channel 134 between the channel and the fiber optic elements 125–129 to increase the luminance of the fiber optic elements 125–129 in low light conditions.

Each of the sighting ends 140, 141, 142, 143 and 144 provided on the face 130 of the sight pin 103 are spaced according to provide the proper target or aiming reference for a particular distance-to-target. Thus, each of the sight tips 141–145 represent a specific target distance. (e.g., 20, 30, 40, 50 and 60 yards, respectively).

Figure 3:
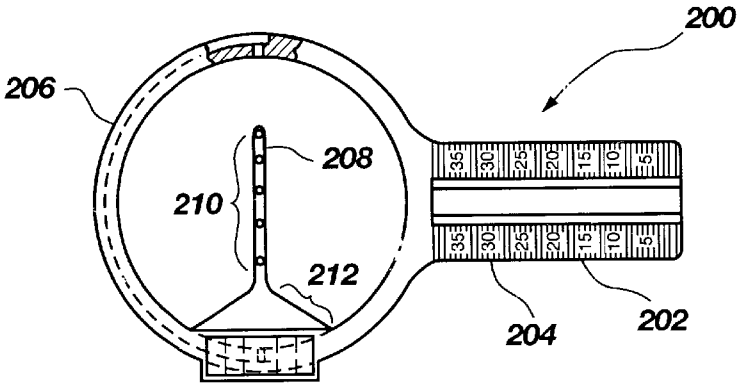
FIG. 3 is a front view of a second embodiment of a fixed pin bow sight in accordance with the principles of the present invention.
Figure 4:
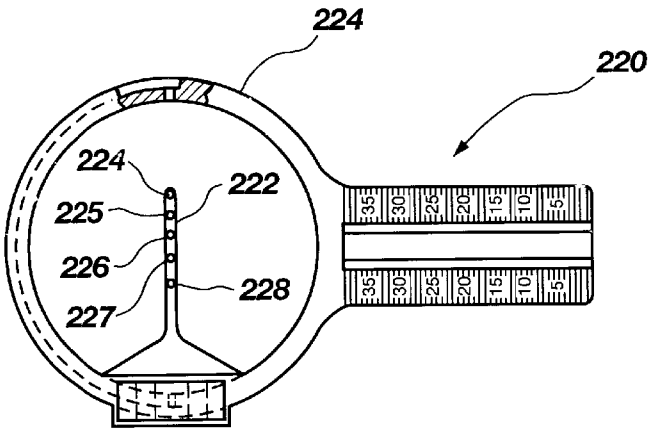
FIG. 4 is a front view of a third embodiment of a fixed pin bow sight in accordance with the principles of the present invention.

FIGS. 3, 4, 5 and 6 illustrate various embodiments of a bow sight in accordance with the present invention. FIGS. 3 and 4 show bow sights, generally indicated at 200 and 220, respectively, that are preferably formed form a polycarbonate or other plastic material that is molded, as by injection molding processes, into the desired shape. The bow sight 200 is comprised of a mounting portion 202 that allows for windage (i.e., lateral or horizontal adjustment) relative to the bow and includes markings 204 thereon for providing reference of the mounting portion during adjustment relative to a mounting bracket (not shown). The mounting portion 202 essentially forms an elongate post member integrally formed with a pin guard portion 206. The pin guard portion 206 encircles a sight pin 208 to protect the sight pin 208 from external obstacles that may be encountered when moving through vegetation during a hunt.

The sight pin 208 is comprised of an elongate post member having a sight tip portion 210 and a base portion 212. The base portion 212 is attached to the guard portion 206 by threaded fastener, an adhesive, or other mechanical attachment methods and devices known in the art. The distance between each individual sight tip is calculated using ballistic formulas. For five sight tips representing 20, 30, 40, 50 and 60 yards, respectively, a bow that will shoot a given arrow at 250 feet per second, and a sight tip to peep sight distance of 26.4 inches when the string is fully drawn, the center of the first sight tip would be 0.025 inches from the top of the sight tip portion. The center of the second tip would be spaced 0.165 inches from the top of the sight tip portion 210. The center of the third tip would be spaced 0.347 inches from the top of the sight tip portion 210. The center of the fourth tip would be spaced 0.547 inches from the top of the sight tip portion 210. Finally, the center of the sixth tip would be spaced 0.760 inches from the top of the sight tip portion 210. While the measurements are taken from the top of the sight pin, the distances between centers of the sight tips can easily be determined by subtracting 0.025 inches from each of the foregoing measurements.

The position of the sight tips relative to the sight pin can be quite precisely positioned using manufacturing techniques known in the art. The tolerances for manufacture can easily be on the order of +/−0.002 inches or more. For example, injection molding, milling and other manufacturing techniques can produce tolerances much greater than that listed above. Such small tolerance for manufacturing produce much closer results to the desired sight tip location along the pin than can be achieved by individual sight pin placement techniques known in the art. Indeed, the spacing between sight tips is orders of magnitude more accurate than manual pin placement with conventional sights.

As shown in FIG. 4, the same sight configuration may be employed to accommodate a bow shooting at a higher velocity, in this case 280 feet per second. Because the sight pin 222 is made as a separate component from the sight guard 224 a manufacturing savings cost is realized. That is, it is not necessary to manufacture a complete sight for every bow speed. Only the sight pin 222, and more specifically, the spacing between sight tips 224, 225, 226, 227 and 228 are different. The spacing from center-to-center of the first 224 and second 225 sight tips is approximately 0.100 inches. The center-to-center distance between the first 224 and third 226 sight tips is approximately 0.238 inches. The center-to-center distance between the first 224 and fourth 227 sight tips is approximately 0.393 inches. The center-to-center distance between the first 224 and fifth 228 sight tips is approximately 0.559 inches. Thus, to accommodate a bow that shoots a given arrow at a particular speed, a sight pin can be selected that is nearest the speed of the bow. For reference and to be in relative proportional size to the size of the sight, the height of the sight pin from the bottom of the base portion to the top is approximately one inch. The length of the sight may also vary based upon the speed of the bow. Thus, depending upon the design of the sight and the sight pin, the length of the sight pin may be of a different length.

In addition, by manufacturing a range of sight pins for various typical bow speeds, for example, 250 fps, 260 fps, 270 fps and 280 fps, a sight pin can be selected that is nearest the bow speed. It is also possible to tune the bow to adjust the speed of the bow in order to get closer to the particular sight pin configuration. If, for example, a bow is shooting at 265 fps, the bow could be adjusted up to shoot at 270 fps or down to shoot at 260 fps. The sight having the appropriate sight pin for that bow speed (i.e., 260 fps) could then be selected.

Figure 5:
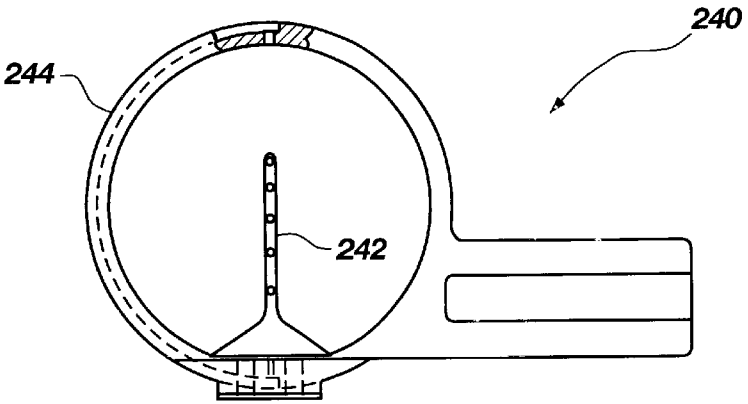
FIG. 5 is a front view of a fourth embodiment of a fixed pin bow sight in accordance with the principles of the present invention.
Figure 6:
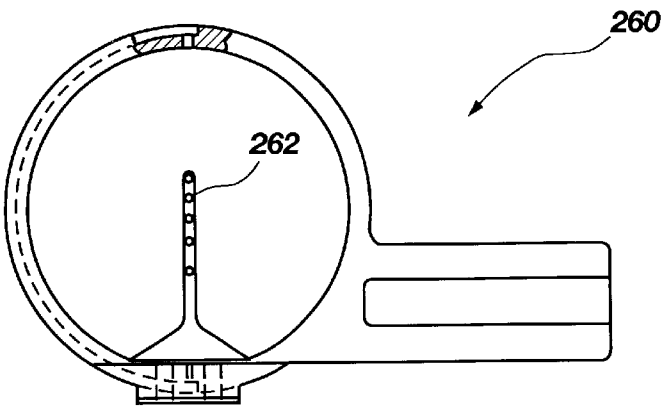
FIG. 6 is a front view of a fifth embodiment of a fixed pin bow sight in accordance with the principles of the present invention.

In FIG. 5, the sight pin 242 and the sight guard 244 of the sight 240 may be separate components as previously described or integrally formed as by casting, molding or machining. The sight 240 may be formed from plastic, aluminum, or other materials known in the art and formed by various techniques known in the art. The sight pin 242 is configured for a bow speed of 250 feet per second and therefore has sight tip spacing similar to that shown in FIG. 3. Likewise, the bow sight 260 of FIG. 6 has a configuration similar to that of FIG. 5 but has a pin 262 configured for a bow speed of 280 feet per second.

For other bow speeds, such as 260 feet per second and 270 feet per second, the distance between sight tips can be calculated. Generally, the faster the speed of the bow, the closer the sight tips are together and thus, the shorter the sight pin for a given sight becomes. With a sight tip to peep sight distance of 26.4 inches, a sight pin for a 260 feet per second bow speed would have sight tips at a spacings of 0.250, 0.153, 0.318, 0.500, and 0.697 relative to the top of the sight pin. For a sight pin for a bow speed of 270 feet per second the distances of the centers of the sight tips would be approximately 0.250, 0.138, 0.288, 0.456, and 0.636 relative to the top of the sight pin.

Figure 7A:
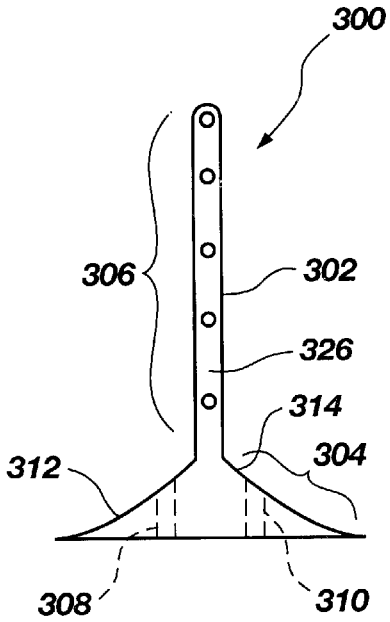
FIGS. 7A and 7B are front and side views of a first embodiment of a single sight pin having multiple sight tips in accordance with the principles of the present invention.
Figure 7B:
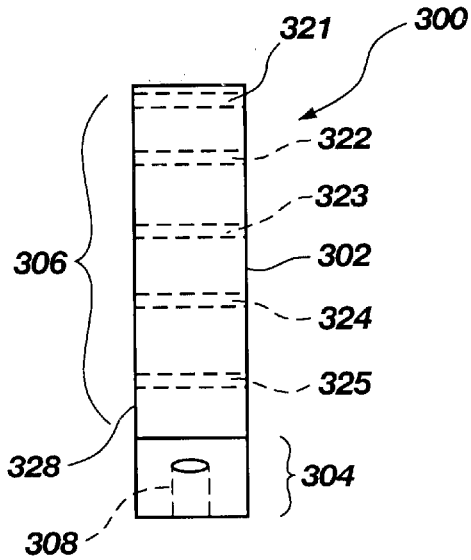

Referring now to FIGS. 7A and 7B, a sight pin, generally indicated at 300, is comprised of an elongate member 302 having a base portion 304 and an upright pin portion 306. The base portion 304 is provided with a pair of internally threaded holes 308 and 310 for attachment to a pin guard or other bow sight structure. The base portion 204 is wider than it is deep to provide lateral support for the pin portion 306. Also, the base portion 304 is provided with tapered sides 312 and 314 that prevent rigidly hold the pin portion 306 in place. By being tapered until engagement with the pin portion 306, stresses at the intersection between the pin portion 306 and the base portion 304 are reduced so that the pin portion 302 is less likely from fracturing or breaking off at this junction. In addition, with the use of a pair of fasteners engaging the holes 308 and 310, the pin 300 can be securely held in place.

The pin portion 306 is provided with a plurality of transversely extending apertures or bores 321, 322, 323, 324 and 325 that extend from the front 326 of the pin portion 306 to the back surface 328 of the pin portion 328. Each hole 321–325 is configured to receive a fiber optic member (not shown) that extends through each hole and terminates proximate the front surface 326 of the pin portion 306. In this manner, the sight tips are exposed and visible by a user along the face 326 of the pin portion 326. It is also contemplated that the holes 321–325 could support opaque sight tip members such as brass members having painted tips that are visible at the face 326. Thus, while the present invention has been described with reference to the use of fiber optic elements, it is also contemplated that the sight indicia provided along the sight pin may by comprised of any material. For example, the sight pin may be formed from a brass element with the individual sight tips painted on the face 326 of the sight pin 300. Thus, it is not necessary to form the sight pin from any particular material so long as the sight tips or individual sighting indicia or indicators are separately visible by a user.

Figure 8:
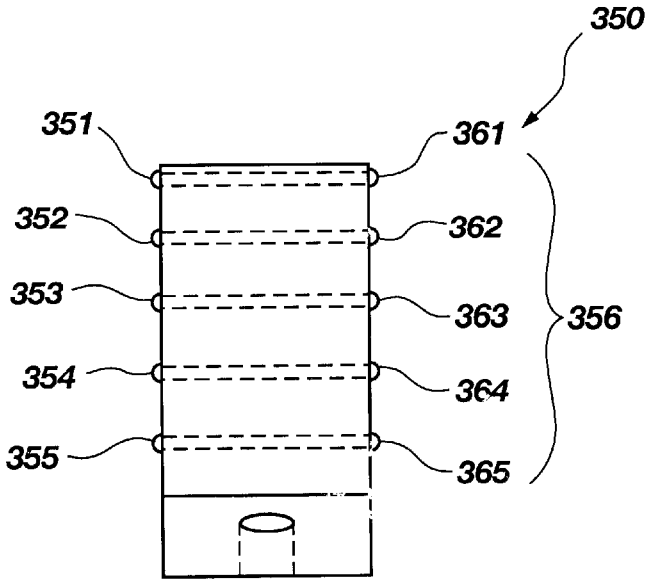
FIG. 8 is a side view of a second embodiment of a single sight pin having multiple sight tips in accordance with the present invention.

As shown in FIG. 8, the depth of the sight pin 350 may be increased to hold a plurality of fiber optic elements 351, 352, 353, 354 and 355 therein. By forming the sight pin portion 356 of a transparent material, the fiber optic elements 351–355 can gather light through the pin portion 356. Also, the longer the fiber optic element, the more light exposure the fiber optic elements 351–355 can receive in order to illuminate the ends 361–365 of the fiber optic elements 351–355. In addition, the pin portion 356 or the entire pin structure may be formed from a self-illuminating material such as a glow-in-the dark material in order to illuminate the fiber optic elements in low light conditions. By encapsulating each fiber optic element along its length with a glow in the dark material, the light captured by the fiber optic element is significantly increased, as opposed to placing glow-in-the dark material only at one end.

Figure 9A:
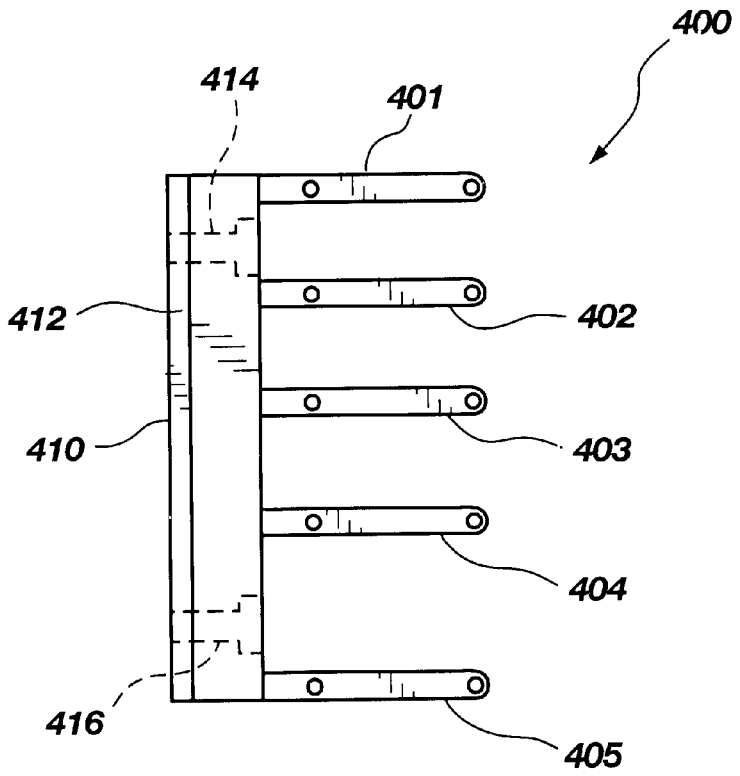
FIGS. 9A and 9B are front and end views, respectively, of a third embodiment of a single sight pin having multiple sight tips in accordance with the principles of the present invention.
Figure 9B:
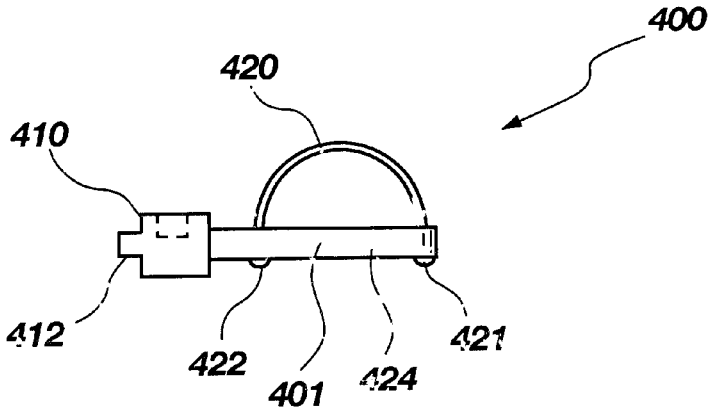

In FIGS. 9A and 9B, a sight pin arrangement, generally indicated at 400 is illustrated. The sight pin assembly 400 is configured to be attachable to a preexisting bow sight known in the art, such as those sold by other manufacturers. The sight pin assembly 400 is comprised of a plurality of precisely spaced sight pins 401, 402, 403, 404 and 405 that are fixedly attached to a sight pin base member 410. The sight pin base 410 is configured to be attached to a conventional bow sight (not shown) as with a tongue 412 and groove (not shown) arrangement and threaded fasteners (not shown) that can be inserted into counterbored holes 414 and 416 and threaded into corresponding nuts to hold the base 410 to the sight. Each sight pin 401–405 is held in a relatively precise position along the base 410 and thus depends outwardly therefrom. In order to properly sight in the sight pin arrangement 400, the base portion 410 is vertically slid relative to the sight until the uppermost sight pin 401 is sighted, whether that be for 20 yards, 25 yards, etc. Once the first pin is properly sighted, the remaining pins are automatically sighted since there position relative to the base member 410 has be predetermined based on ballistic calculations for a given bow speed.

As specifically shown in FIG. 9B, each sight pin, such as the sight pin 401, is configured similarly to sight pins known in the art with a looped segment 420 of fiber optic material having beaded ends 421 and 422 for holding the fiber optic segment 420 relative to the pin arm 424. It is also noted (as represented by dashed lines) that the base portion 410 may be provided with a longitudinally extending groove for receiving a corresponding tongue portion provided by the pin plate of the sight (not shown).

Figure 10A:
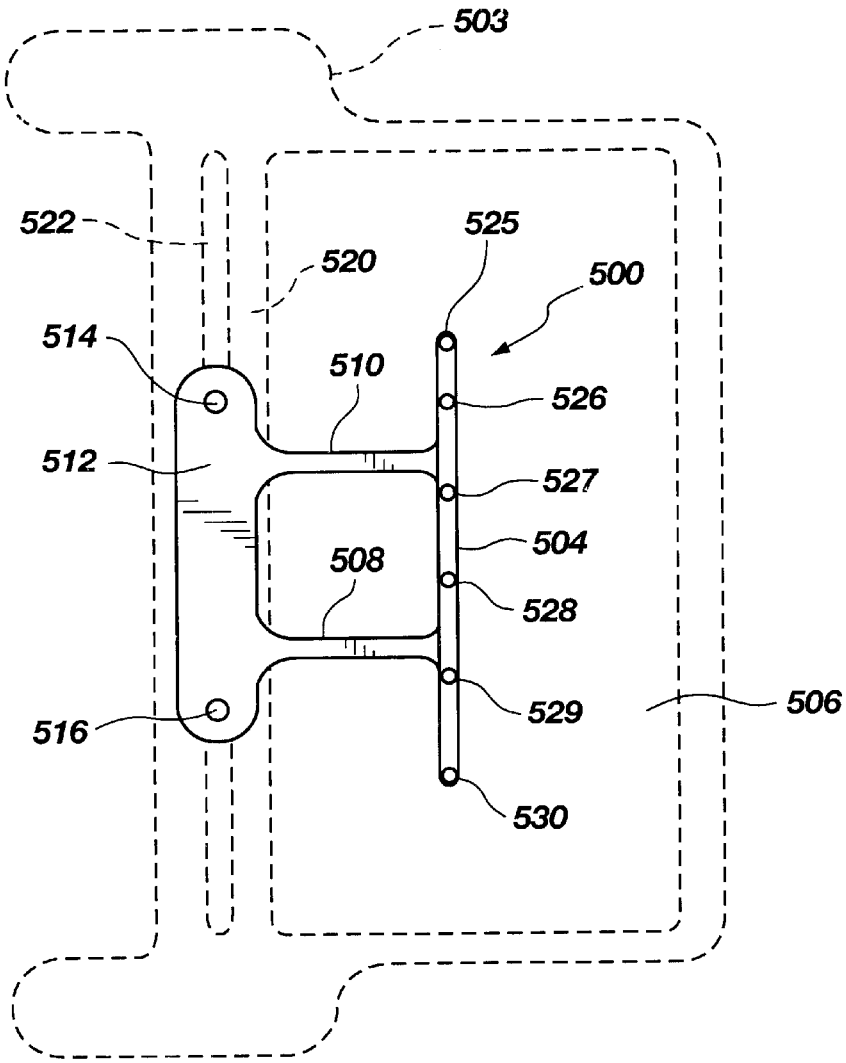
FIGS. 10A and 10B are front and side views, respectively, of a fourth embodiment of a single sight pin having multiple sight tips in accordance with the principles of the present invention.
Figure 10B:
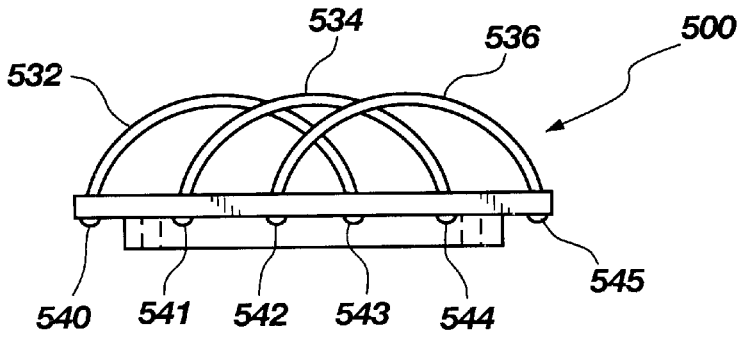

Referring now to FIGS. 10A and 10B, a sight pin 500 is illustrated in relation to a bow sight 502 (shown in dashed lines). The sight pin 500 is comprised of an elongate pin member 504 positioned vertically within the sight 502. The elongate pin member 504 is supported within the sight window 506 by a pair of struts 508 and 510. The struts 508 and 510 are connected to an attachment member 512 configured for attaching the sight pin 500 to a bow sight 502. The bow sight 502 has been drawn in dashed lines to indicate that the bow sight 502 may be of any configuration including those currently being manufactured or those manufactured in the future by archery product manufacturers in the industry. The pin attachment member 512 is provided with a pair of holes 514 and 516 for cooperating with a pair of threaded fasteners or the like to attach the pin attachment member 512 to the pin plate 520 of the bow sight 502. By providing a pin sight 502 having a vertical slot 522 in the pin plate, the sight pin 500 can be vertically adjusted relative to the sight 502 in order to adjust the elongate pin member 504 within the sight window 506. It is also contemplated that the sight pin 500 could be fixedly attached to the pin plate so as to position the elongate pin member 504 centrally within the sight window 506. In such a case, a pair of matching holes in the pin plate 520 may be provided to allow the pin attachment member 512 to be attached to the pin plate 520. Of course, those of skill in the art will appreciate that there may be other means and mechanisms of attaching the pin attachment portion 512 to the sight 502 depending on the configuration of the particular sight. Thus, by incorporating features of an existing sight and sight pins into the sight pin of the present invention, the sight pin 500 could be adapted to attach to other bow sights known in the art.

The elongate pin member 504 is provided with a plurality of holes 525, 526, 527, 528, 529 and 530 for receiving a plurality of fiber optic members. As further illustrated in FIG. 10B, three fiber optic members 532, 534 and 536 inserted through the holes 525–530 in order to provided sight tips 540–545. In order to at least partially conceal the fiber optic member loops 532, 534 and 536, the loops 532, 534 and 536 are positioned behind the elongate pin member 504. In this case, six sight tips are provided by the three fiber optic members 532, 534 and 536, with each fiber optic member providing two sight tips. Thus, for example, by using green, yellow and red fiber optic members, the sight tips could be seen as red, yellow, green, red, yellow, green.

Figure 11A:
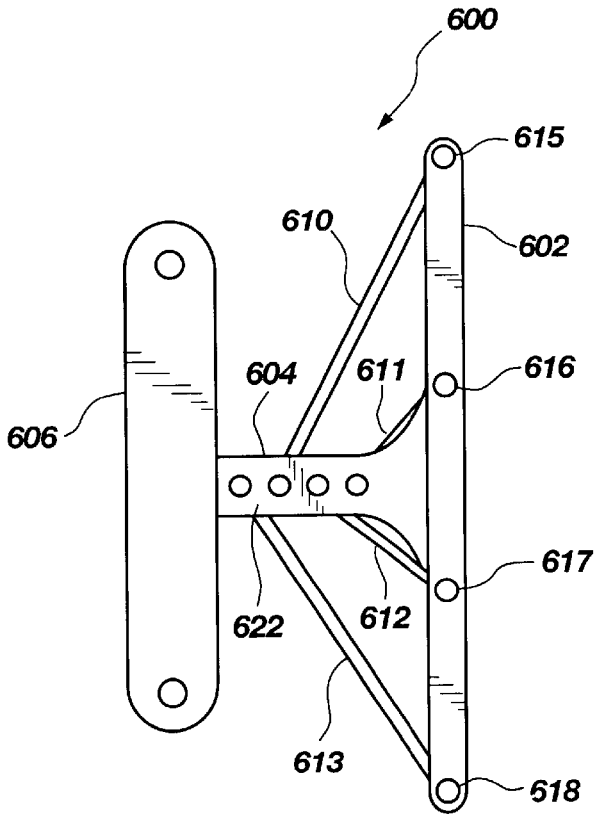
FIGS. 11A and 11B are front and side views, respectively, of a fifth embodiment of a single sight pin having multiple sight tips in accordance with the principles of the present invention.
Figure 11B:
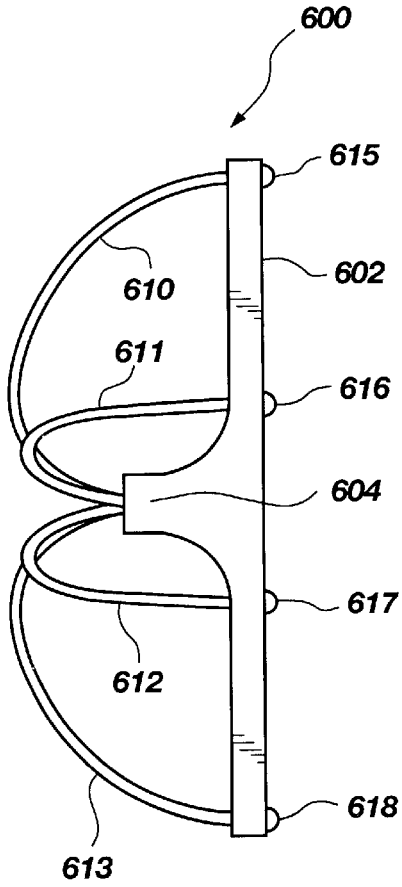

FIGS. 11A and 11B illustrate another embodiment of a sight pin assembly 600 in accordance with the present invention. With a similar configuration to the sight pin of FIG. 10A, the sight pin assembly 600 is comprised of an elongate pin member 602, a pin member support 604 comprised of a single strut, and a pin attachment member 606 configured for attaching the pin assembly 600 to a sight (not shown). In this case, four fiber optic members 610, 611, 612 and 613 provided four sight tips 615, 616, 617 and 618, respectively. The opposite ends of the fiber optic elements 610–613 terminate in the face 622 of the strut 604. Each of the four sight tips 615–618 represent various distances to target (e.g., 20, 40, 60 and 80 yards, respectively). Each of the pin member 602, support strut 604 and pin attachment portion 606 may be integrally formed into a single component as by molding, casting, machining or other techniques known in the art.

Figure 12:
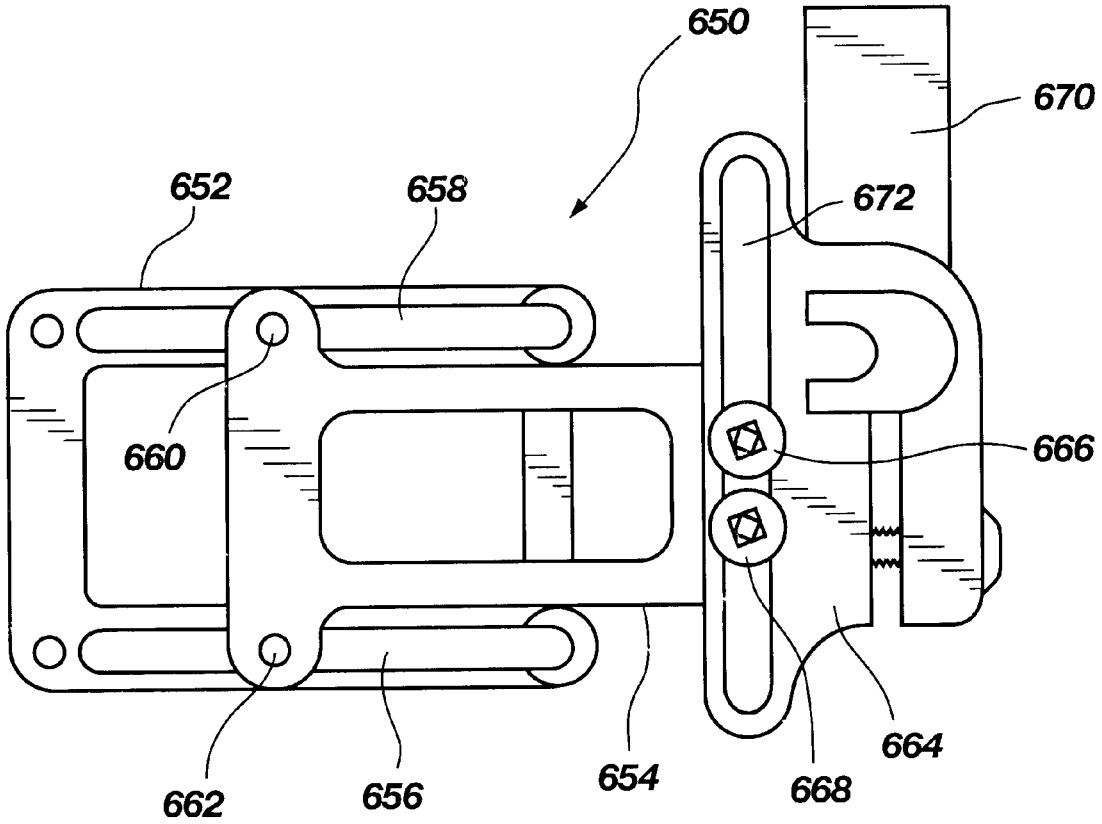
FIG. 12 is a side view of a first embodiment of a mounting structure for mounting a bow sight in accordance with the principles of the present invention.

As previously discussed, in order to relatively precisely position the sight tips at a specific distance from the peep sight when the string of the bow is fully drawn, the sight may need to be moved either toward or away from the string of the bow. This allows the sight tips to be at, for example, 26.4 inches from the peep sight and thus make the sight tips more accurately represent their respective yardages. As such, as illustrated in FIG. 12, a sight attachment bracket assembly 650 is comprised of a pair of slidably engageable bracket members 652 and 654. The first bracket member 652 is configured to be mounted to the riser of a bow (not shown). The second bracket member 652 is capable of being slid relative to the first bracket member 652 by engaging with slots 656 and 658. Threaded fasteners that engage with holes 660 and 662 are configured to hold the first and second bracket members together when the desired position of the sight 670 is obtained. A sight mounting bracket 664 is attached with threaded fasteners 666 and 668 to the second mounting bracket 654. The fasteners 666 and 668 cooperate with slot 672 to allow vertical adjustment of the sight 670 relative to the second mounting bracket 662.

Figure 13:
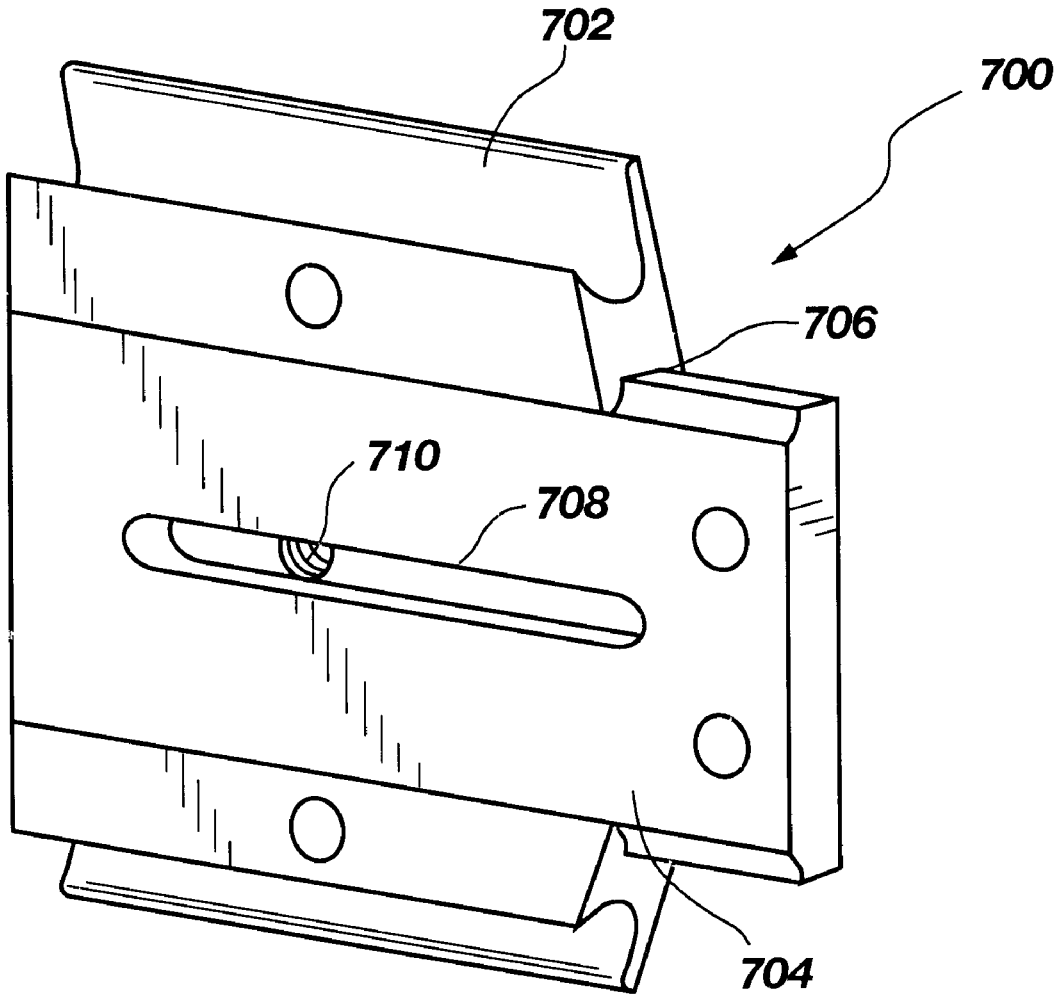
FIG. 13 is a side view of a second embodiment of a mounting structure for mounting a bow sight in accordance with the principles of the present invention.

Another example of a mounting bracket that will allow adjustment of the sight horizontally relative to the riser of a bow is shown in FIG. 13. The bracket assembly 700 is comprised of a pair of slidably engageable bracket members 702 and 704. The bracket member 702 provides a channel 706 for receiving and retaining the second bracket member 704. The second bracket member is provided with an elongate slot 708 for receiving the shaft of a threaded fastener therein with the threaded fastener engaging with threaded hole 710 provided in the first bracket member 702. By tightening the threaded fastener, the second bracket member 704 will be held relative to the first bracket member 702.

Figure 14B:
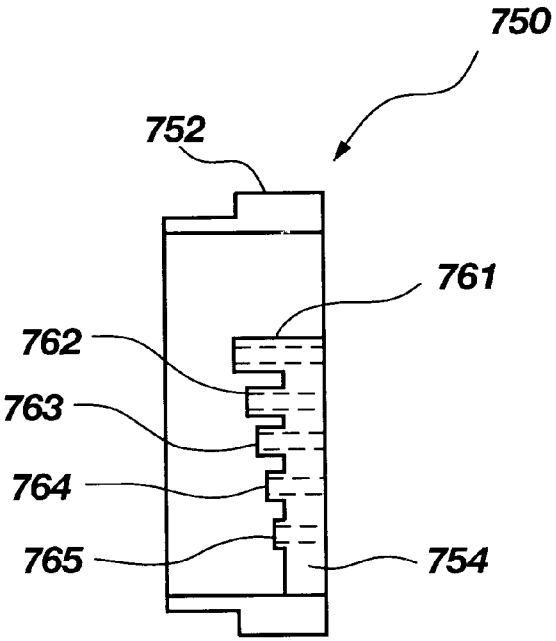
FIGS. 14A and 14B are front and partial cross-sectional side views, respectively, of a sixth embodiment of a sight pin in accordance with the principles of the present invention.
Figure 14A:
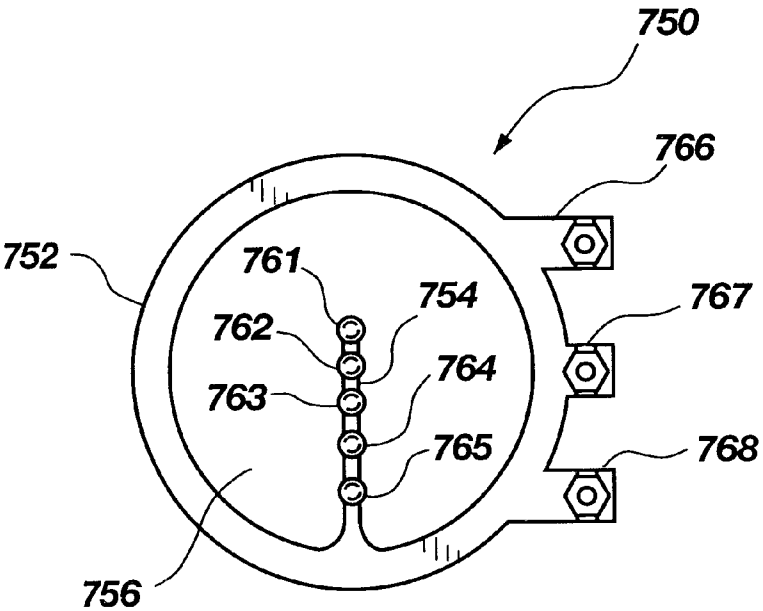

Yet another embodiment of a sight pin assembly in accordance with the principles of the present invention is illustrated in FIGS. 14A and 14B. The sight pin assembly 750 is comprised of a pin guard 752 which defines a sight window 756 and supports a sight pin 754. The sight pin is provided with a plurality of sight tip apertures 761–765. Fiber optic elements may be provided in each of the sight tip apertures 761–765 to provide sight tips visible in the sight window 756. The pin guard 752 is attached to a mounting bracket (not shown) with a plurality of attachment tabs 766, 767 and 768 that cooperate with threaded fasteners to attach the sight 750 to a bow. The diameter of the sight guard 752 is configured to substantially match the diameter of the peep sight when a user looks through the peep sight on a fully drawn bow string. In that way, the user can easily align the sight relative to the peep sight when shooting the bow.

Figure 15A:
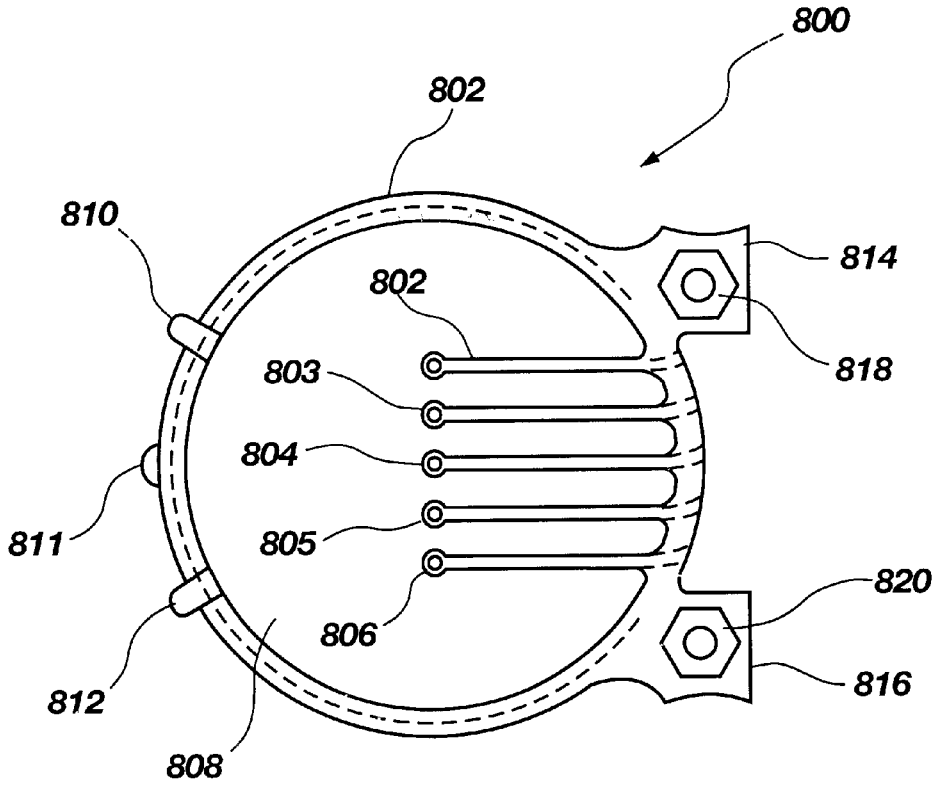
Figure 15B:
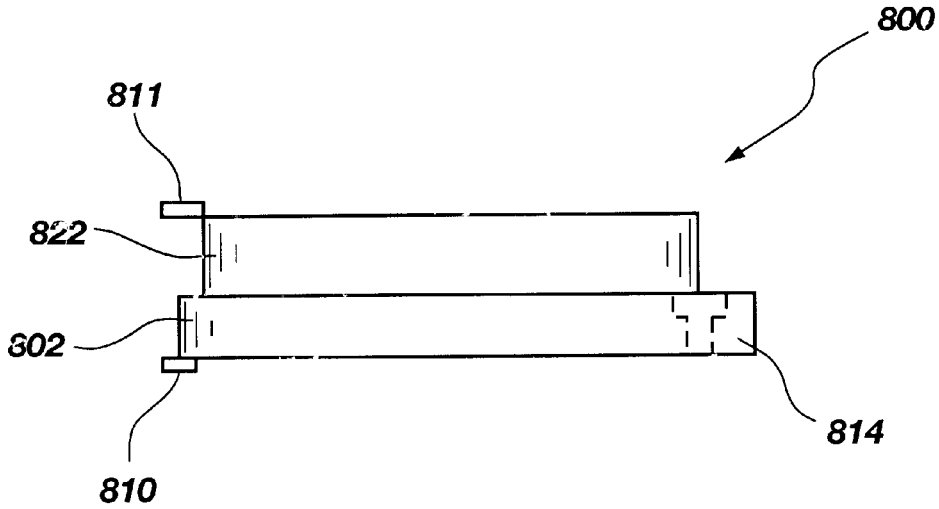

Finally, as shown in FIGS. 15A and 15B, a bow sight, generally indicated at 800 is comprised of a pin guard 802 configured for mounting into a bow sight similar to that illustrated in FIG. 1, essentially forming a sight within a sight. The pin guard supports a plurality of fixed pins 802–806 that extend horizontally into the sight window 808. A plurality of tabs 810, 811, and 812 for engaging the pin guard of the bow sight (see FIG. 1) to which the bow sight 800 is attached. The pin guard 800 is attached to the pin plate of the other sight with attachment portions 814 and 816 that cooperate with threaded fasteners 818 and 820, respectively.

Fiber optic elements provide sight tips in each of the fixed pins 802–806 and may be wrapped around the guard 802 in the channel or recessed portion 822. A glow-in-the dark material (such as a glow-in-the dark tape) may be attached to the channel 822 in order to illuminate the fiber optic elements in low light conditions. Ths, the glow-in-the-dark material would be placed between the guard 802 and the fiber optic elements.

While the present invention has been described with reference to certain embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. A bow sight, comprising:

a pin mounting portion;

a sight mounting portion; and a sight pin having a plurality of sight tips thereon, each of said plurality of sight tips in fixed positions along said sight pin and each configured for a different distance-to-target depending upon arrow trajectory.

2. The bow sight of claim 1, wherein said sight pin comprises an elongate member having a plurality of apertures therein for receiving a plurality of fiber optic members, each of said plurality of fiber optic members defining an end which forms one of said plurality of sight tips.

3. The bow sight of claim 1, wherein said sight pin comprises a mounting portion and a plurality of pin arms extending from said mounting portion, said mounting portion configured for mounting to said pin mounting portion and each of said plurality of pin arms defining one of said plurality of sight tips.

4. The bow sight of claim 1, wherein said sight pin is formed from a luminescent material.

5. The bow sight of claim 1, wherein said sight pin is formed from a translucent material.

6. The bow sight of claim 1, wherein said sight pin defines a plurality of transversely extending apertures each configured for receiving a fiber optic element and exposing an end of the fiber optic element to provide one of the plurality of sight tips.

7. The bow sight of claim 2, further including a pin guard, said pin guard defining a channel therein and said plurality of fiber optic members extending through at least a portion of said channel.

8. The bow sight of claim 7, further including a luminescent material within said channel, at least a portion of said plurality of fiber optic members abutting said luminescent material.

9. The bow sight of claim 1, further including a pin guard and wherein said sight pin comprises a plurality of pin arms integrally formed with said pin guard.

10. The bow sight of claim 1, wherein said sight pin is integrally formed with said pin mounting portion.

11. A sight pin, comprising:

an elongate pin arm having a pin mounting portion and a plurality of sight tips thereon, each of said plurality of sight tips in fixed positions along said pin arm and each configured for a different distance-to-target depending upon arrow trajectory.

12. The sight pin of claim 11, wherein said pin arm further comprises a plurality of apertures therein for receiving a plurality of fiber optic members, each of said plurality of fiber optic members defining an end which forms one of said plurality of sight tips.

13. The sight pin of claim 11, wherein said pin arm is formed from a luminescent material.

14. The sight pin of claim 11, wherein said pin arm is formed from a translucent material.

15. The sight pin of claim 11, wherein said pin arm defines a plurality of transversely extending apertures each configured for receiving a fiber optic element and exposing an end of the fiber optic element to provide one of the plurality of sight tips.

16. The sight pin of claim 12, wherein said pin arm is configured for mounting to a bow sight having a pin guard, said pin guard defining a channel therein and said plurality of fiber optic members extending through at least a portion of said channel.

17. The sight pin of claim 16, further including a luminescent material within said channel, at least a portion of said plurality of fiber optic members abutting said luminescent material.

18. The sight pin of claim 11, wherein said pin mounting portion is integrally formed with a bow sight.

19. The sight pin of claim 11, wherein said pin mounting portion is integrally formed with a pin guard of a bow sight.

* * * * *